US011225725B2

(12) United States Patent
Nunomura et al.

(10) Patent No.: US 11,225,725 B2
(45) Date of Patent: Jan. 18, 2022

(54) METHOD FOR PRODUCING ALUMINUM

(71) Applicant: UACJ CORPORATION, Tokyo (JP)

(72) Inventors: Junji Nunomura, Tokyo (JP); Yukio Honkawa, Tokyo (JP); Yoichi Kojima, Tokyo (JP); Mikito Ueda, Sapporo (JP)

(73) Assignee: UACJ CORPORATION, Tokyo (JP)

( * ) Notice: Subject to any disclaimer, the term of this patent is extended or adjusted under 35 U.S.C. 154(b) by 0 days.

(21) Appl. No.: 16/506,081

(22) Filed: Jul. 9, 2019

(65) Prior Publication Data

US 2019/0330752 A1 Oct. 31, 2019

Related U.S. Application Data

(63) Continuation of application No. PCT/JP2018/004511, filed on Feb. 9, 2018.

(30) Foreign Application Priority Data

Feb. 9, 2017 (JP) ..... JP2017-022080

(51) Int. Cl.

| | |
|---|---|
| ***C25C 1/02*** | (2006.01) |
| ***C25C 1/22*** | (2006.01) |
| ***C25C 3/18*** | (2006.01) |

(52) U.S. Cl.

CPC ..... *C25C 3/18* (2013.01)

(58) Field of Classification Search

CPC .. C25D 3/44; C25D 3/665; C25C 3/18; C25C 1/02; C25C 1/22

USPC ..... 205/233, 237, 261, 560

See application file for complete search history.

(56) References Cited

U.S. PATENT DOCUMENTS 3,545,920 A * 12/1970 George ..... C22B 21/0015 423/112
3,816,605 A * 6/1974 Belsky ..... C22B 21/0015 423/626
4,039,648 A 8/1977 Haupin et al.
(Continued)

FOREIGN PATENT DOCUMENTS

CN 1930313 A 3/2007
CN 101509138 A 8/2009
(Continued)

OTHER PUBLICATIONS

Quek et al., "Synthesis and Properties of N, N'-Dialkylimidazolium Bis (Nonafluorobutane-1-Sulfonyl) Imides: A New Subfamily of Ionic Liquids," Tetrahedron (Mar. 27, 2006), vol. 62, No. 13, pp. 3137-3145. (Year: 2006).*
(Continued)

*Primary Examiner* — Edna Wong
(74) *Attorney, Agent, or Firm* — Dorsey & Whitney LLP

(57) ABSTRACT

A method for producing aluminum includes: a dissolution step of dissolving a hydrate containing Al in water to prepare an aqueous solution that contains Al ions; an extraction step of bringing an organic phase that is composed of an extractant into contact with an aqueous phase that is composed of the aqueous solution to extract the Al ions in the aqueous phase into the organic phase; and an electrodeposition step of electrolyzing the organic phase as an electrolytic solution to electrodeposit metallic Al onto a surface of a cathode from the Al ions in the electrolytic solution.

5 Claims, 2 Drawing Sheets

(56) References Cited

U.S. PATENT DOCUMENTS

| | | | | |
|---|---|---|---|---|
| 2007/0278106 | A1* | 12/2007 | Shaw | C22B 21/0015 205/372 |
| 2011/0000782 | A1* | 1/2011 | Reddy | C25C 3/24 204/158.2 |
| 2015/0211135 | A1 | 7/2015 | Fan | |
| 2016/0244860 | A1* | 8/2016 | Roebuck | C07D 401/04 |
| 2017/0183790 | A1* | 6/2017 | Fournier | C25C 1/02 |

FOREIGN PATENT DOCUMENTS

| | | | |
|---|---|---|---|
| CN | 101979680 | A | 2/2011 |
| CN | 102050747 | A | 5/2011 |
| CN | 103572323 | A | 2/2014 |
| JP | S52049249 | | 4/1977 |
| JP | S5272396 | A | 6/1977 |
| JP | S55158289 | | 12/1980 |
| JP | H01272790 | A | 10/1989 |
| JP | 2015077583 | A | 4/2015 |
| WO | 2018147399 | A1 | 8/2018 |

OTHER PUBLICATIONS

English translation of International Preliminary Report on Patentability received in PCT/JP2018/004511, dated Aug. 13, 2019.

English translation of Written Opinion of the International Search Authority received in PCT/JP2018/004511 dated Mar. 27, 2018.

International Search Report and Written Opinion dated Mar. 27, 2018 for PCT Application No. PCT/JP2018/004511, 6 pages.

English translation of Office Action from CN Application No. 201880001623.7, dated Jan. 6, 2021.

[English translation] Notification to Grant Patent Right for Invention for CN Application No. 201880001623.7, dated Jun. 10, 2021.

[English Translation] Decision to Grant a Patent for Japanese Application No. 2018-523826, dated Aug. 16, 2021.

* cited by examiner

Cyclic voltammogram of [BMI][NFO] after extraction

METHOD FOR PRODUCING ALUMINUM

CROSS REFERENCE TO RELATED APPLICATIONS

This is a continuation application of International Patent Application No. PCT/JP2018/004511 filed Feb. 9, 2018, which claims the benefit of Japanese Patent Application No. 2017-022080 filed Feb. 9, 2017, the full contents of all of which are hereby incorporated by reference in their entirety.

BACKGROUND

Technical Field

The present disclosure relates to an inexpensive and environmentally friendly method for producing aluminum.

Description of the Related Art

The standard electrode potential of aluminum (hereinafter referred to as "Al") is significantly lower than that of hydrogen, and accordingly it is impossible to use an aqueous solution at the time of electroplating. Thus, conventionally, an Al electroplating method is known which uses a non-aqueous solution such as a molten salt or an organic solvent as an electrolytic solution (Japanese Patent Application Publication No. 1-272790). Specifically, in Japanese Patent Application Publication No. 1-272790, (here is disclosed an Al electroplating method using a molten salt bath of anhydrous $AlCl_3$ and (di)alkyl imidazolium.

Anhydrous $AlCl_3$ can be produced by reading metallic Al with chlorine gas. Metallic Al is produced by firstly refining aluminum oxide from bauxite (Bayer process), and thereafter melting aluminum oxide and conducting electrolysis (Hall-Heroult process). In the Hall-Heroult process, a large amount of energy (electricity) is used. Accordingly, in the method for producing Al by an electroplating method using anhydrous $AlCl_3$ as a raw material, a production cost is very high and energy consumption is also large. In addition, chlorine gas which is used for producing anhydrous $AlCl_3$ needs to clear environmental emission standards, and accordingly the use of chlorine gas is not desirable from the environmental point of view. Therefore, in production of Al, it is required to reduce the production cost and consider the environment.

On the other hand, $AlCl_3.6H_2O$, which is a hydrate, can be produced by reacting aluminum hydroxide with hydrochloric acid. Aluminum hydroxide is obtained in a process of washing bauxite with sodium hydroxide which is an intermediate step of the Bayer process. Accordingly, the process does not use a large amount of energy (electricity). In addition, aluminum hydroxide also has such an advantage as to effectively utilize a waste liquid of an etchant which has been used in a process of producing aluminum foil for an electrolytic capacitor, by precipitating metallic Al from Al ions which are contained in the waste liquid.

However, $AlCl_3.6H_2O$ is difficult to dissolve in a molten salt or an organic solvent which have been conventionally used for the Al electroplating. In addition, even if $AlCl_3.6H_2O$ has been dissolved, the standard electrode potential of Al tends to become significantly low; and accordingly, if water derived from a hydrate exists in the electrolytic solution, Al plating does not proceed, but electrolysis of water preferentially occurs. Because of this, no technology has been found so far to produce Al by using an electrolytic solution containing $AlCl_3.6H_2O$.

SUMMARY

The present disclosure is related to providing a method for producing aluminum as to be capable of efficiently and simply electrodeposition aluminum by electrolytic reaction, while being inexpensive and considering the environment.

According to an aspect of the present disclosure, a method for producing aluminum includes: a dissolution step of dissolving a hydrate containing aluminum in water to prepare an aqueous solution that contains aluminum ions; an extraction step of bringing an organic phase that is composed of an extractant into contact with an aqueous phase that is composed of the aqueous solution to extract the aluminum ions in the aqueous phase into the organic phase; and an electrodeposition step of electrolyzing the organic phase as an electrolytic solution to electrodeposit metallic aluminum onto surface of a cathode from the aluminum ions in the electrolytic solution In the dissolution step, a concentration of the aluminum ions in the prepared aqueous solution is 0.01 to 1 M; as for extraction conditions in the extraction step, a volume ratio between the aqueous phase and the organic phase that are brought into contact with each other (aqueous phase/organic phase) is 0.1 to 2, a bath temperature is 20 to 100° C., and a stirring time period is 1 to 60 minutes; and as for electrodeposition conditions in the electrodeposition step, a bath temperature is 20 to 350° C., and an electric current density is 1 to 1000 $\mu A/cm^2$.

Further, it is preferable that the hydrate containing aluminum is a hydrate of an aluminum halide.

Further, it is preferable that the electrolytic solution is the organic phase from which the aqueous phase is separated after the extraction step.

Further, it is preferable that the electrolytic solution is a hydrophobic ionic liquid including an imidazolium-based cation and an imide-based or amide-based anion.

Further, it is preferable that the ionic liquid includes 1-butyl-3-methylimidazolium cation and bis(nonafluorobutanesulfonyl) imide anion.

According to the present disclosure, the method for producing aluminum can be provided which can efficiently and simply electrodeposit aluminum by electrolytic reaction while being inexpensive and considering the environment.

DETAILED DESCRIPTION

Figure 1:
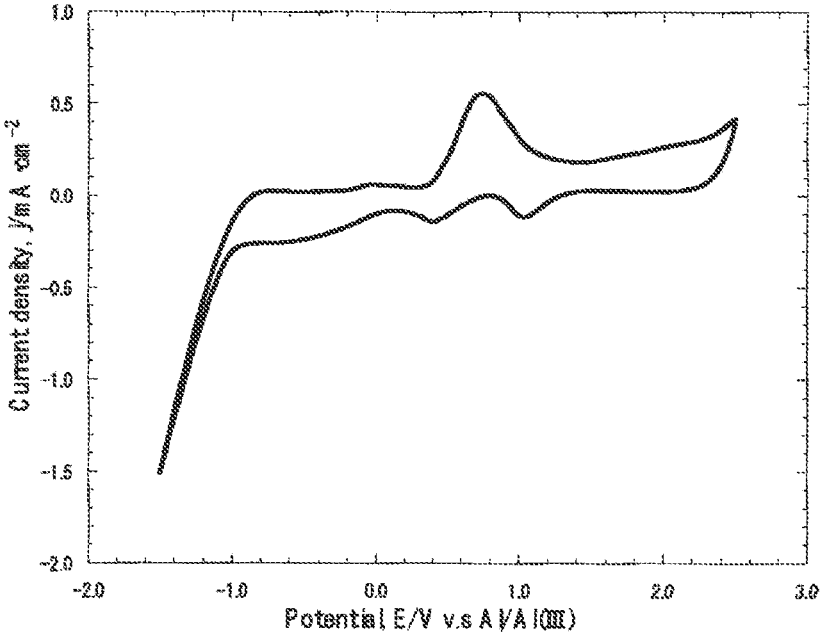
FIG. 1 illustrates Voltammogram obtained by cyclic voltammetry

A method for producing aluminum of the present disclosure includes: a dissolution step of dissolving a hydrate containing aluminum in water to prepare an aqueous solution that contains aluminum ions; an extraction step of bringing an organic phase that is composed of an extractant into contact with an aqueous phase that is composed of the aqueous solution to extract the aluminum ions in the aqueous phase into the organic phase; and an electrodeposition step of electrolyzing the organic phase as an electrolytic solution to electrodeposit metallic aluminum onto surface of a cathode from the aluminum ions in the electrolytic solution. The method for producing aluminum of the present disclosure is a method of migrating aluminum ions from an aqueous phase to an organic phase by a solvent extraction method utilizing a difference in ion distribution between two liquids, and then obtaining metallic aluminum by electrodeposition. Hereinafter, each step will be described in detail.

[Dissolution Step]

In the method for producing aluminum of the present disclosure, firstly, a hydrate containing aluminum is dissolved in water to prepare an aqueous solution containing aluminum ions. When this aqueous solution is mixed with an extractant, the aqueous solution is separated and becomes an aqueous phase. A hydrate of aluminum halide is preferable as the hydrate containing aluminum. Examples of the hydrate or aluminum halide include $AlCl_3.6H_2O$, $AlF_3.3H_2O$ and $AlBr_3.6H_2O$, and $AlCl_3.6H_2O$ is preferable in view of being easily dissolved in water.

The concentration of aluminum ions in the aqueous solution is 0.01 M or higher and 1 M or lower, and preferably is 0.05 M or higher and 0.5 M or lower. If the concentration of aluminum ions is lower than 0.01 M, it is not possible to extract a sufficient amount of aluminum ions for being electrodeposited into the organic phase. In addition, when the concentration of aluminum ions exceeds 1 M, the amount of aluminum ions extracted into the organic phase ends up being saturated. Specifically, even if the concentration of aluminum ions in the aqueous solution (aqueous phase) is enhanced, the amount of aluminum ions extracted into the organic phase does not increase. Accordingly, when a ratio of "the amount of aluminum ions which have migrated to the organic phase" to "the amount of aluminum ions which have initially existed in the aqueous solution as the aqueous phase" is defined as an extraction rate, if the concentration of aluminum ions is increased to be higher than 1 M, the extraction rate ends up decreasing. Incidentally, M means mol/L, which is a unit of concentration.

[Extraction Step]

After preparing the aqueous solution containing the aluminum ions, an extractant is prepared. When the aqueous solution containing the aluminum ions and the extractant are added in the same container, the aqueous solution becomes an aqueous phase, the extractant becomes an organic phase, and the phases are separated. Then, in the present disclosure, an aqueous phase composed of the aqueous solution is brought into contact with an organic phase composed of the extractant, and aluminum ions are extracted into the organic phase by a solvent extraction method.

The extractant used in the present disclosure is not limited in particular as long as the extractant is a liquid capable of extracting the aluminum ions, but the extractant is preferably an ionic liquid so that the extractant can be used as an electrolytic solution in a subsequent electrodeposition step. The ionic liquid is a general term for ionic compounds consisting of a combination of cationic species and anionic species, and many ionic liquids form a liquid phase at a low temperature of 100° C. or lower. There is also an ionic liquid of which the vapor pressure is very low and which can be used even in vacuum such as SEM. The ionic liquid can exhibit hydrophobicity by appropriately selecting the anionic species.

As for the ionic liquid, an ionic liquid is particularly preferable which consists of an imide-based anion or amide-based anion and an imidazolium-based cation. Examples of the imide-based anion include bis(trifluoromethanesulfonyl) imide anion and bis(nonafluorobutanesulfonyl)imide anion. In addition, examples of the amide-based anion include nonafluoro-N-[(trifluoromethane)sulfonyl]butane sulfonylamide anion. In addition, examples of the imidazolium-based cation include 1-ethyl-3-methylimidazolium cation and 1-butyl-3-methylimidazolium cation. Among those, an ionic liquid consisting of 1-butyl-3-methylimidazolium cation and bis(nonafluorobutanesulfonyl) imide anion (hereinafter referred to as "BMI-NFO") is suitable for extracting the aluminum ions from $AlCl_3.6H_2O$, and is also preferable as the electrolytic solution for electrodeposition of metallic aluminum.

When the aqueous phase (aqueous solution containing aluminum ions) is brought into contact with the organic phase (extractant), the volume ratio (aqueous phase/organic phase) is 0.1 or larger and 2 or smaller, and is preferably 0.5 or larger and 1 or smaller. When the volume ratio is smaller than 0.1, the amount of aluminum ions is small and the aluminum cannot be electrodeposited. On the other hand, when the volume ratio is larger than 2, the amount of the extractant is small and the amount of the cations that can be exchanged with aluminum ions is small, and accordingly aluminum ions resist migrating from the aqueous phase to the organic phase.

In addition, the contact between the aqueous phase and the organic phase is carried out by stirring at a bath temperature of 20° C. or higher to 100° C. or lower for 1 minute to 60 minutes. The bath temperature is preferably 40° C. or higher and 80° C. or lower, and the stirring time period is preferably 10 minutes or longer and 20 minutes or shorter. When the bath temperature is lower than 20° C., aluminum ions resist migrating from the aqueous phase to the organic phase. On the other hand, when the bath temperature exceeds 100° C., the temperature exceeds the boiling point of water, and accordingly it is impossible to properly control the concentration of aluminum ions in the aqueous phase. In addition, if the stirring time period is shorter than 1 minute, aluminum ions do not sufficiently migrate from the aqueous phase to the organic phase. On the other hand, if the stirring time period exceeds 60 minutes, the amount of aluminum ions to be extracted into the organic phase ends up being saturated. Incidentally, the stirring apparatus for stirring the aqueous phase and the organic phase is not limited in particular, but for example, includes a vortex mixer.

[Electrodeposition Step]

After extracting aluminum ions into the organic phase, it is preferable to collect only the organic phase containing aluminum ions. Thereby, an extractant containing aluminum ions is obtained. The extractant containing the aluminum ions as an electrolytic solution is added in an electrolysis tank, an anode and a cathode ore arranged in the electrolysis tank so as to face each other, and a direct current is passed between the anode and the cathode to electrodeposit metallic aluminum on a surface of the cathode.

The standard electrode potential of aluminum is −1.662 Vvs.SHE (standard hydrogen electrode). Thus, it is usually impossible to electrodeposit aluminum from an aqueous solution. Then, a molten salt containing an aluminum salt or a solution obtained by dissolving an aluminum salt in an organic solvent is generally used as an electrolytic solution for electrodepositing the aluminum therefrom.

The molten salt can be roughly divided into an inorganic molten salt and an organic molten salt. Conventionally, the molten salt has been used as the organic-based molten salt, which contains, for example, 1-butylpyridinium chloride (hereinafter referred to as "BPC") or 1-ethyl-3-methylimidazolium chloride (hereinafter referred to as "EMIC") and anhydrous $AlCl_3$. In a mixture of EMIC and the anhydrous $AlCl_3$, a melting point lowers to the vicinity of −50° C. depending on the composition. Accordingly, Al plating can be carried out in a lower temperature environment. However, the molten salts containing BPC or EMIC and the anhydrous $AlCl_3$ have high hygroscopicity. For example, in the case of the molten salt containing EMIC and $AlCl_3$, the reactions shown in the following Formulae (1) to (5) proceed when water exists.

$$EMIC \rightarrow EMI + Cl^- \quad (1)$$

$$Cl^- + AlCl_3 \leftrightarrows AlCl_4^- \quad (2)$$

$$AlCl_3 + AlCl_4^- \leftrightarrows Al_2Cl_7^- \quad (3)$$

$$AlCl_4^- + H_2 \leftrightarrows AlOHCl_3^- + HCl \leftrightarrows AlOCl_3^- + 2HCl \quad (4)$$

$$Al_2Cl_7^- + H_2 \leftrightarrows Al_2OHCl_6^- + HCl \leftrightarrows Al_2OCl_5^- + 2HCl \quad (5)$$

As is expressed by the above Formulae (1) to (3), $Cl^-$ which is generated by dissociation of EMIC reacts with $AlCl_3$ to form $Al_2Cl_7^-$ which is necessary for Al plating. However, when water exists, $AlCl_4^-$ and $Al_2Cl_7^-$ react with water as are expressed in the above Formulae (4) and (5), respectively, and $Al_2Cl_7^-$ ends up disappearing. Accordingly, in the case where $AlCl_3.6H_2O$ is combined with an ionic liquid such as BPC and EMIC, $Al_2Cl_7^-$ disappears due to hydrate-derived water; and accordingly even if an electrolytic solution can be prepared, metallic aluminum cannot be electrode posited on a substrate.

In contrast to this, in the present disclosure, only aluminum ions which exist in the aqueous phase are migrated to the organic phase by the use of the solvent extraction method, so that the above described reactions do not proceed, and the electrolytic solution containing rich in aluminum ions can be prepared.

In the present disclosure, when the aluminum is elect rode posited, the bath temperature is 20° C. or higher and 350° C. or lower, and preferably is 50° C. or higher 300° C. or lower. When the bath temperature is lower than 20° C., the viscosity of the electrolytic solution becomes high and the electric current density cannot be increased. On the other hand, it the bath temperature exceeds 350° C., the electrolytic solution decomposes, thus it is not preferable. Furthermore, energy for keeping the temperature of the electrolytic solution is also large, deterioration of the electrolysis tank is also promoted, and accordingly the production efficiency lowers.

In addition, when the aluminum is electrodeposited, the electric current density is 1 $\mu A/cm^2$ or higher and 1000 $\mu A/cm^2$ or lower. When the electric current density is lower than 1 $\mu A/cm^2$, the rate of electrodeposition is slow, thus it is unproductive. On the other hand, when the electric current density exceeds 1000 $\mu A/cm^2$, the electrolytic solution decomposes, thus it is accordingly not preferable.

A material of the cathode is not limited in particular, but examples of the materials include metallic materials such as platinum, iron, copper, titanium, nickel and carbon, and plastic materials to which conductivity is imparted. In addition, as for the anode, aluminum can be used it the anode is a soluble anode, and carbon or the like can be used it the anode is an insoluble anode.

EXAMPLE

Hereinafter, preferred embodiments of the present disclosure are specifically described in accordance with examples and comparative examples, but the present disclosure is not limited to these Examples.

(Cyclic Voltammetry)

BMI-NFO as the ionic liquid was dried at 60° C. for 65 hours; a platinum wire with 0.5 mmϕ (immersion length of 8 mm) was used as a working electrode, an Al wire was used as a reference electrode, and glassy carbon was used as a counter electrode; and cyclic voltammetry was carried out by a potentiostat. The cyclic voltammetry was carried out at a scanning speed of 100 mV/s, a scanning range of −1.5 V to 2.5 V, and a bath temperature of 25° C. The obtained voltammogram is shown in FIG. 1. It is considered from this result that an increase of a cathode current in the vicinity of 0 V corresponds to the deposition of metallic Al, and an increase of an anode current in the vicinity of 0.3 V corresponds to the dissolution of the metallic Al, respectively. It has been found that the metallic Al can be produced in the BMI-NFO.

Examples 1 to 28 and Comparative Examples 1 to 12

[Dissolution Step]

$AlCl_3.6H_2O$ was dissolved in distilled water, and aqueous solutions of $AlCh_3.6H_2O$ having Al ion concentrations described in Table 1 were prepared.

[Extraction Step]

The prepared aqueous solution (aqueous phase) of $AlCl_3.6H_2O$ and BMI-NFO (organic phase) were added in a micro tube at a volume ratio (aqueous phase/organic phase) shown in Table 1. Then, these were stirred with a vortex mixer at a bath temperature and for a stirring time period shown in Table 1.

[Electrodeposition Step]

After the completion of stirring, the aqueous phase and the organic phase were separated with a microsyringe, and only the organic phase was recovered. The recovered organic phase was added in an electrolysis tank, and constant current electrolysis was carried out with the use of a platinum wire of 0.5 mmϕ (immersion length of 8 mm) for a cathode and glassy carbon for an anode, at a bath temperature and an electric current density shown in Table 1. The platinum wire after the completion of the electrolysis was washed with water and dried, and then the presence of the electrodeposit on the surface of the platinum wire was visually confirmed.

The produced Al plated platinum wire was subjected to the following evaluations. The evaluation results are shown in Table 1.

(Extraction Rate)

The concentration of Al ions in the aqueous solution of $AlCl_3.6H_2O$ after the completion of the extraction step was measured by ICP-AES. When the concentration of Al ions in the aqueous solution of $AlCl_3.6H_2O$ prepared in the dissolution step is represented by A1 and the concentration of Al ions in the aqueous solution of $AlCl_3.6H_2O$ after the completion of the extraction step is represented by A2, the extraction rate (%) is represented by $\{(A1-A2)/(A1)\}\times 100$. The extraction rate was calculated from the values of A1 and A2. When the extraction rate was 1.0% or higher, it was evaluated that Al was efficiently electrodeposited.

(Analysis by SEM-EDS)

Figure 2:
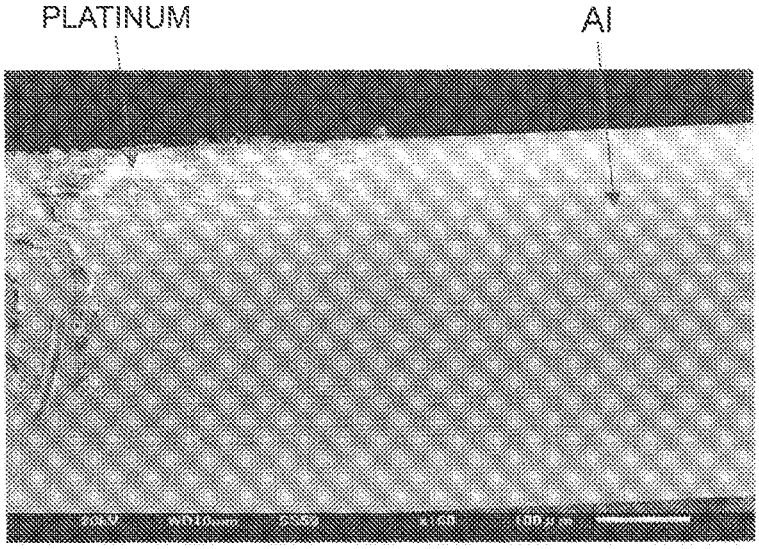
FIG. 2 illustrates SEM image of Example 12

Electrodeposits on the surfaces of the platinum wires were observed with SEM-EDS (manufactured by JEOL, SEM: Scanning Electron Microscope, EDS: Energy Dispersive X-ray Spectroscope); and an example on which Al was detected was evaluated as "○", and an example on which Al was not detected was evaluated as "×". FIG. 2 is an SEM image of the electrodeposit obtained in Example 12.

TABLE 1

| | Dissolution step | Extraction step | | | Electrodeposition step | | Evaluation | |
|---|---|---|---|---|---|---|---|---|
| | Concentration of Al Ions [M] | Volume ratio (water phase/organic phase) | Bath temperature [° C.] | Stirring time period [min] | Bath temperature [° C.] | Electric current density [μA/cm$^2$] | Extraction rate [%] | SEM-EDS |
| Example 1 | 0.01 | 1 | 60 | 20 | 100 | 10 | 1.4 | ○ |
| Example 2 | 0.05 | 1 | 60 | 20 | 100 | 10 | 2.5 | ○ |
| Example 3 | 0.1 | 1 | 60 | 20 | 100 | 10 | 3.1 | ○ |
| Example 4 | 0.5 | 1 | 60 | 20 | 100 | 10 | 4.1 | ○ |
| Example 5 | 1 | 1 | 60 | 20 | 100 | 10 | 5.3 | ○ |
| Example 6 | 0.1 | 0.1 | 60 | 20 | 100 | 10 | 1.2 | ○ |
| Example 7 | 0.1 | 0.2 | 60 | 20 | 100 | 10 | 3.7 | ○ |
| Example 8 | 0.1 | 0.5 | 60 | 20 | 100 | 10 | 5.1 | ○ |
| Example 9 | 0.1 | 2 | 60 | 20 | 100 | 10 | 5.2 | ○ |
| Example 10 | 0.1 | 1 | 20 | 20 | 100 | 10 | 1.1 | ○ |
| Example 11 | 0.1 | 1 | 40 | 20 | 100 | 10 | 2.4 | ○ |
| Example 12 | 0.1 | 1 | 80 | 20 | 100 | 10 | 6.5 | ○ |
| Example 13 | 0.1 | 1 | 100 | 20 | 100 | 10 | 3.2 | ○ |
| Example 14 | 0.1 | 1 | 60 | 20 | 20 | 10 | 3.8 | ○ |
| Example 15 | 0.1 | 1 | 60 | 20 | 50 | 10 | 3.5 | ○ |
| Example 16 | 0.1 | 1 | 60 | 20 | 150 | 10 | 3.6 | ○ |
| Example 17 | 0.1 | 1 | 60 | 20 | 300 | 10 | 3.7 | ○ |
| Example 18 | 0.1 | 1 | 60 | 20 | 350 | 10 | 3.3 | ○ |
| Example 19 | 0.1 | 1 | 60 | 1 | 100 | 10 | 1.1 | ○ |
| Example 20 | 0.1 | 1 | 60 | 5 | 100 | 10 | 1.6 | ○ |
| Example 21 | 0.1 | 1 | 60 | 10 | 100 | 10 | 3.5 | ○ |
| Example 22 | 0.1 | 1 | 60 | 60 | 100 | 10 | 4.7 | ○ |
| Example 23 | 0.1 | 1 | 60 | 20 | 100 | 1 | 3.6 | ○ |
| Example 24 | 0.1 | 1 | 60 | 20 | 100 | 5 | 3.5 | ○ |
| Example 25 | 0.1 | 1 | 60 | 20 | 100 | 50 | 3.3 | ○ |
| Example 26 | 0.1 | 1 | 60 | 20 | 100 | 100 | 3.8 | ○ |
| Example 27 | 0.1 | 1 | 60 | 20 | 100 | 500 | 3.9 | ○ |
| Example 28 | 0.1 | 1 | 60 | 20 | 100 | 1000 | 3.1 | ○ |
| Comparative Example 1 | 0.005 | 1 | 60 | 20 | 100 | 20 | 0.1 | ○ |
| Comparative Example 2 | 5 | 1 | 60 | 20 | 100 | 20 | 0.9 | ○ |
| Comparative Example 3 | 0.1 | 0.05 | 60 | 20 | 100 | 20 | 1.5 | X |
| Comparative Example 4 | 0.1 | 3 | 60 | 20 | 100 | 20 | 0.3 | ○ |
| Comparative Example 5 | 0.1 | 1 | 10 | 20 | 100 | 20 | 0 | X |
| Comparative Example 6 | 0.1 | 1 | 120 | 20 | 100 | 20 | 0 | X |
| Comparative Example 7 | 0.1 | 1 | 60 | 0.5 | 100 | 20 | 0.7 | X |
| Comparative Example 8 | 0.1 | 1 | 60 | 70 | 100 | 20 | 0.9 | X |
| Comparative Example 9 | 0.1 | 1 | 60 | 20 | 10 | 20 | 5.6 | X |
| Comparative Example 10 | 0.1 | 1 | 60 | 20 | 400 | 20 | 5.8 | X |
| Comparative Example 11 | 0.1 | 1 | 60 | 20 | 100 | 0.5 | 5.8 | X |
| Comparative Example 12 | 0.1 | 1 | 60 | 20 | 100 | 2000 | 4.9 | X |

As shown in Table 1, any of Examples 1 to 28 includes the dissolution step, the extraction step and the electrodeposition step, and the conditions of these steps are also within the scope of the present disclosure; and accordingly Al ions could be efficiently extracted, the extraction rate was as high as 1.0% or higher, and Al could be electrodeposited.

On the other hand, in Comparative Example 1, in the dissolution step, the concentration of Al ions in the aqueous solution was as low as 0.005 M, and accordingly the amount of Al ions which migrated from the aqueous phase to the organic phase was small, and the extraction rate was as low as 0.1%.

In Comparative Example 2, in the dissolution step, the concentration of Al ions in the aqueous solution was as high as 5 M, accordingly it was not possible to efficiently extract Al ions, and the extraction rate was as low as 0.9%.

In Comparative Example 3, in the extraction step, the volume ratio between the aqueous phase and the organic phase (aqueous phase/organic phase) was as low as 0.05, and accordingly it was not possible to electrodeposit Al from Al ions.

In Comparative Example 4, in the extraction step, the volume ratio between the aqueous phase and the organic phase (aqueous phase/organic phase) was as high as 3, accordingly it was not possible to efficiently extract Al ions, and the extraction rate was as low as 0.3%.

In Comparative Example 3, in the extraction step, the bath temperature was as low as 10° C., and accordingly it was not possible to migrate Al ions from the aqueous phase to the organic phase, and to electrodeposit Al from Al ions.

In Comparative Example 6, in the extraction step, the bath temperature was as high as 120° C., and accordingly it was not possible to migrate Al ions from the aqueous phase to the organic phase, and to electrodeposit Al from Al ions.

In Comparative Example 7, in the extraction step, the stirring time period was as short as 0.5 minutes, accordingly the amount of Al ions which migrated from the aqueous phase to the organic phase was small, and it was not possible to electrodeposit Al from Al ions.

In Comparative Example 8, in the extraction step, the stirring time period was as long as 70 minutes, accordingly it was not possible to efficiently extract Al ions, and the extraction rate was as low as 0.9%.

In Comparative Example 9, in the electrodeposition step, the bath temperature was as low as 10° C., and accordingly it was not possible to electrodeposit Al.

In Comparative Example 10, in the electrodeposition step, the bath temperature was as high as 400° C., and accordingly it was not possible to electrodeposit Al.

In Comparative Example 11, in the electrodeposition step, the electric current density was as low as 0.5 $\mu A/cm^2$, and accordingly it was not possible to electrodeposit Al.

In Comparative Example 12, in the electrodeposition step, the electric current density was as high as 2000 $\mu A/cm^2$, and accordingly it was not possible to electrodeposit Al.

As described above, the method for producing aluminum of the present disclosure includes: a dissolution step of dissolving a hydrate containing aluminum in water to prepare an aqueous solution that contains aluminum ions; an extraction step of bringing an organic phase that is composed of an extractant into contact with an aqueous phase that is composed of the aqueous solution to extract the aluminum ions in the aqueous phase into the organic phase; and an electrodeposition step of eleetrolyzing the organic phase as an electrolytic solution to electrodeposit metallic aluminum onto surface of a cathode from the aluminum ions in the electrolytic solution. By appropriately controlling the conditions of these steps, it is possible to efficiently electrode posit Al. In addition, the hydrate containing aluminum, in particular, $AlCl_3.6H_2O$ which is a raw material can be inexpensively produced and also be available from waste liquids, and accordingly it is possible to reduce a production cost in the production of aluminum while considering the environment.

What is claimed is:

1. A method for producing aluminum comprising:

a dissolution step of dissolving a hydrate containing aluminum in water to prepare an aqueous solution that contains aluminum ions;

an extraction step of bringing an organic phase that is composed of an extractant into contact with an aqueous phase that is composed of the aqueous solution to extract the aluminum ions in the aqueous phase into the organic phase; and an electrodeposition step of electrolyzing the organic phase as an electrolytic solution to electrodeposit metallic aluminum onto surface of a cathode from the aluminum ions in the electrolytic solution, in the dissolution step, a concentration of the aluminum ions in the prepared aqueous solution being 0.01 to 1 M;

as for extraction conditions in the extraction step, a volume ratio between the aqueous phase and the organic phase that are brought into contact with each other (aqueous phase/organic phase) being 0.1 to 2, a bath temperature being 20 to 100° C., and a stirring time period being 1 to 60 minutes; and as for electrodeposition conditions in the electrodeposition step, a bath temperature being 20 to 350° C., and an electric current density being 1 to 1000 $\mu A/cm^2$.

2. The method for producing aluminum according to claim 1, wherein the hydrate containing aluminum is a hydrate of an aluminum halide.

3. The method for producing aluminum according to claim 1, wherein the electrolytic solution is the organic phase from which the aqueous phase is separated after the extraction step.

4. The method for producing aluminum according to claim 1, wherein the extractant is a hydrophobic ionic liquid including an imidazolium-based cation and an imide-based or amide-based anion.

5. The method for producing aluminum according to claim 4, wherein the imidazolium-based cation is 1-butyl-3-methylimidazolium cation and the imide-based anion is bis(nonafluorobutanesulfonyl) imide anion.

* * * * *